US006805141B2

(12) United States Patent
Elsner et al.

(10) Patent No.: US 6,805,141 B2
(45) Date of Patent: Oct. 19, 2004

(54) MIXTURES OF GEMINI SURFACTANTS AND FATTY ALCOHOL ALKOXYLATES IN RINSE AGENTS

(75) Inventors: Michael Elsner, Solingen (DE); Ditmar Kischke, Monhelm (DE); Manfred Weuthen, Langenfeld (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 10/317,445

(22) Filed: Dec. 12, 2002

(65) Prior Publication Data

US 2003/0119703 A1 Jun. 26, 2003

(30) Foreign Application Priority Data

Dec. 18, 2001 (DE) ..... 101 62 023

(51) Int. Cl.[7] ..... B08B 3/04; C11D 1/72; C11D 3/37

(52) U.S. Cl. ..... 134/25.2; 134/25.3; 134/39; 134/40; 134/42; 510/220; 510/356; 510/360; 510/413; 510/421; 510/475; 510/505; 510/506; 510/514; 510/521; 510/524; 510/535; 568/613; 568/622; 523/400; 523/406

(58) Field of Search ..... 510/220, 356, 510/360, 413, 421, 475, 505, 506, 514, 521, 524, 535; 134/25.2, 25.3, 39, 40, 42; 568/613, 622; 523/400, 406

(56) References Cited

U.S. PATENT DOCUMENTS 5,759,987 A * 6/1998 Haerer et al. ..... 510/514
2003/0008801 A1 * 1/2003 Raths et al. ..... 510/421
2003/0036496 A1 * 2/2003 Elsner et al. ..... 510/421
2003/0078176 A1 * 4/2003 Elsner et al. ..... 510/220
2003/0078182 A1 * 4/2003 Kischkel et al. ..... 510/421
2003/0114348 A1 * 6/2003 Kischkel et al. ..... 510/446
2003/0119703 A1 * 6/2003 Elsner et al. ..... 510/421

FOREIGN PATENT DOCUMENTS

| | | | | |
|---|---|---|---|---|
| DE | 4321022 | * | 1/1995 | ..... C07C/303/24 |
| DE | 10121722 | * | 11/2002 | ..... C11D/1/825 |
| DE | 10121724 | * | 11/2002 | ..... C11D/1/825 |
| DE | 10137925 | * | 2/2003 | ..... C08L/29/02 |
| DE | 10152142 | * | 4/2003 | ..... C11D/17/00 |
| GB | 1543992 | * | 4/1979 | ..... C08K/5/05 |

* cited by examiner

*Primary Examiner*—Brian P. Mruk
(74) *Attorney, Agent, or Firm*—Aaron R. Ettelman; Steven J. Trzaska; Daniel S. Ortiz

(57) ABSTRACT

A rinse agent composition containing: (a) a gemini surfactant corresponding to formula I:

$$R—CHOH—CH_2—[OCH_2CH_2]_x—O—CH_2—CHOH—R \quad (I)$$

wherein R is a linear or branched alkyl and/or alkenyl radical having from about 4 to 22 carbon atoms, and x is a number from about 5 to 90; and (b) a fatty alcohol alkoxylate corresponding to formula II:

$$R^1O[CH_2(CH_3)CHO]_q(CH_2CH_2O)_rH \quad (II)$$

wherein $R^1$ is a linear or branched alkyl and/or alkenyl group having from about 4 to 22 carbon atoms, and q is a number up to about 10, and r is a number from about 1 to 50, and wherein (a) and (b) are present in the composition in a ratio by weight of from about 1:1 to 4:1.

20 Claims, No Drawings

MIXTURES OF GEMINI SURFACTANTS AND FATTY ALCOHOL ALKOXYLATES IN RINSE AGENTS

BACKGROUND OF THE INVENTION

This invention relates to rinse agents containing mixtures of gemini surfactants and fatty alcohol alkoxylates, optionally in conjunction with typical rinse agent ingredients, and to the use of these mixtures for improving wetting behavior in rinse agents.

Compositions for the washing and cleaning of hard non-textile surfaces occurring in the home and in the institutional sector are generally intended to generate little foam in use, the foam they do generate being expected to collapse significantly in a few minutes. Compositions of this type are well-known and established on the market. They are essentially aqueous surfactant solutions of various kinds with and without added builders, solubilizers (hydrotropes) or solvents. Although the consumer prefers the in-use solution to foam to a certain extent at the beginning of the cleaning task as proof of effectiveness, the foam is expected to collapse rapidly so that cleaned surfaces do not have to be rewiped. To this end, low-foaming nonionic surfactants are normally added to compositions of the type mentioned.

Today, machine-washed tableware has to meet stricter requirements than hand-washed tableware. Thus, even tableware completely free from food residues is regarded as unsatisfactory when, after dishwashing, it still has whitish stains which are attributable to water hardness or other mineral salts and which come from water droplets that have remained on the tableware through lack of wetting agent and dried.

Accordingly, to obtain bright, spotless tableware, rinse agents have to be used. The addition of liquid or solid rinse agent—which may be separately added or which is already present in ready-to-use form together with the detergent and/or regenerating salt ("2-in-1", "3-in-1", for example in the form of tablets and powders)—ensures that the water drains completely from the tableware so that the various surfaces are bright and free from residues at the end of the dishwashing program.

Commercially available rinse agents are mixtures of, for example, nonionic surfactants, solubilizers, organic acids and solvents, water and optionally preservative and perfumes.

The function of the surfactants in these compositions is to influence the interfacial tension of the water in such a way that it is able to drain from the tableware as a thin, coherent film so that no droplets of water, streaks or films remain behind during the subsequent drying process (so-called wetting effect). Accordingly, another function of surfactants in rinse agents is to suppress the foam generated by food residues in the dishwashing machine. Since the rinse agents generally contain acids to improve the clear drying effect, the surfactants used also have to be relatively hydrolysis-resistant towards acids.

Rinse agents are used both in the home and in the institutional sector. In domestic dishwashers, the rinse agent is added after the prerinse and wash cycle at 40 to 65° C. Institutional dishwashers use only one wash liquor which is merely replenished by addition of the rinse agent solution from the preceding wash cycle. Accordingly, there is no complete replacement of water in the entire dishwashing program. Because of this, the rinse agent is also expected to have a foam-suppressing effect, to be temperature-stable in the event of a marked drop in temperature from 85 to 35° C. and, in addition, to be satisfactorily resistant to alkali and active chlorine.

The problem addressed by the present invention was to provide rinse agents which, at one and the same time, would show good foaming and cleaning behavior, but especially very good drainage behavior on plastic surfaces, i.e. an improvement in wetting behavior on plastic surfaces.

The problem stated above has been solved by the use of a selected combination of gemini surfactants and fatty alcohol alkoxylates.

DESCRIPTION OF THE INVENTION

The present invention relates to rinse agents containing a. gemini surfactants corresponding to formula (I)

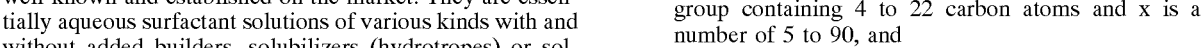

$$R—CHOH—CH_2—[OCH_2CH_2]_x—O—CH_2—CHOH—R \quad (I)$$

in which R is a linear or branched alkyl and/or alkenyl group containing 4 to 22 carbon atoms and x is a number of 5 to 90, and b. fatty alcohol alkoxylates corresponding to formula (II):

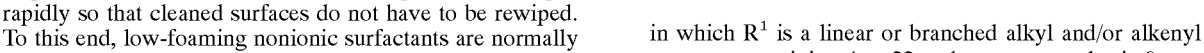

$$R^1O[CH_2(CH_3)CHO]_q(CH_2CH_2O)_rH \quad (II)$$

in which $R^1$ is a linear or branched alkyl and/or alkenyl group containing 4 to 22 carbon atoms and q is 0 or a number of 1 to 10 and r is a number of 1 to 50, and optionally other ingredients typically present in rinse agents, characterized in that components a and b are present in a ratio of 1:1 to 4:1.

Gemini Surfactants

Gemini surfactants are generally obtained by reacting 1,2-epoxyalkanes ($CH_2CHO—R$), where R is a linear or branched, saturated or unsaturated alkyl and/or alkenyl group, with polyols.

Polyol in the present context is intended to be regarded as the collective name for polyhydric alcohols and polyalkylene glycols, i.e. as an organic compound which contains at least two hydroxy groups in the molecule. Polyalkylene glycols also include reaction products of polyhydric alcohols with alkoxylating agents, such as ethylene oxide and propylene oxide.

According to the invention, polyethylene glycol $H—[OCH_2CH_2]_x—OH$ is used as the polyol.

Gemini surfactants corresponding to formula (I) where x=10 to 45 and preferably 12 to 35 are particularly preferred.

Gemini surfactants corresponding to formula (I) where R is a linear or branched alkyl group containing 8 to 12 carbon atoms are most particularly preferred.

Gemini surfactants corresponding to formula (I) where R is a linear alkyl group containing 8 to 12 carbon atoms and more particularly 10 carbon atoms are also preferred.

A preferred embodiment of the rinse agents according to the invention containing gemini surfactants corresponding to formula (I) is characterized in that they contain at least 80% by weight, preferably 85 to 100% by weight and more particularly 95 to 100% by weight of gemini surfactants where all the free hydroxy groups of the polyethylene glycol are end-capped by 1,2-epoxyalkane units.

Another embodiment of the rinse agents according to the invention is characterized in that they contain the gemini surfactants according to the invention and other ingredients typically present in rinse agents. As described in the following, these typical ingredients include other nonionic surfactants, anionic surfactants and other auxiliaries and additives.

Particularly preferred rinse agents contain the gemini surfactants corresponding to formula (I) and fatty alcohol alkoxylates corresponding to formula (II) in a ratio of a:b of 1.5:1 to 3:1.

Nonionic Surfactants

The rinse agents according to the invention may contain other nonionic surfactants. Typical examples of nonionic surfactants are alkyl and/or alkenyl oligoglycosides, end-capped alkoxylates of alkanols with no free OH groups, alkoxylated fatty acid lower alkyl esters, amine oxides, alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates (more particularly wheat-based vegetable products), polyol fatty acid esters, sugar esters, sorbitan esters and polysorbates. If the nonionic surfactants contain polyglycol ether chains, they may have a conventional homolog distribution although they preferably have a narrow homolog distribution.

According to the invention, the rinse agents according to the invention may contain anionic surfactants.

Anionic Surfactants

Typical examples of anionic surfactants are soaps, alkyl benzenesulfonates, secondary alkane sulfonates, olefin sulfonates, alkyl ether sulfonates, glycerol ether sulfonates, α-methyl ester sulfonates, sulfofatty acids, alkyl and/or alkenyl sulfates, alkyl ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids such as, for example, acyl lactylates, acyl tartrates, acyl glutamates and acyl aspartates, alkyl oligoglucoside sulfates, protein fatty acid condensates (particularly wheat-based vegetable products) and alkyl (ether) phosphates. If the anionic surfactants contain polyglycol ether chains, the polyglycol ether chains may have a conventional homolog distribution, although they preferably have a narrow homolog distribution.

The anionic surfactants are preferably selected from the group consisting of alkyl and/or alkenyl sulfates, alkyl ether sulfates, alkyl benzenesulfonates, monoglyceride (ether) sulfates and alkanesulfonates, more particularly fatty alcohol sulfates, fatty alcohol ether sulfates, secondary alkanesulfonates and linear alkyl benzenesulfonates.

Auxiliaries and Additives

The rinse agents according to the invention may contain, for example, solubilizers, such as cumenesulfonate, ethanol, isopropyl alcohol, ethylene glycol, propylene glycol, butyl glycol, diethylene glycol, propylene glycol monobutyl ether, polyethylene or polypropylene glycol ethers with molecular weights of 500 to 1,500,000 and preferably with a molecular weight of 400,000 to 800,000 or, more particularly, butyl diglycol as typical ingredients or auxiliaries and additives. Organic acids, such as mono- and/or polybasic carboxylic acids, preferably citric acid, and preservatives and perfumes may also be used.

In a preferred embodiment, the rinse agents contain at least 50% by weight of water, based on the rinse agent.

Commercial Applications

The present invention also relates to the use of gemini surfactants corresponding to formula (I) and fatty alcohol alkoxylates corresponding to formula (II) in the ratio according to the invention for improving wetting behavior in rinse agents, preferably on hard surfaces, more particularly in combined products of dishwasher detergents and rinse agents.

In contrast to the hitherto known hydroxy mixed ethers, the combination according to the invention of gemini surfactants and selected fatty alcohol alkoxylates in the ratio according to the invention—besides its foam-suppressing effect and high compatibility, particularly with plastics—is distinguished by its relatively high melting points. It is thus particularly suitable for the simplified production of solid formulations. The mixtures according to the invention of gemini surfactants and fatty alcohol alkoxylates are solid in a ratio of 1:1 to 4:1. For example, 1:4 mixtures are liquid at room temperature. The solid surfactant mixtures are easy to handle and can be incorporated particularly well in solid combined preparations of detergent and rinse agent for dishwashing machines.

In addition, by virtue of their relatively high melting points, the mixtures according to the invention dissolve later in the wash liquor and develop their effect with delay and in a relatively high concentration.

The rinse agents may be present both as aqueous solutions and in solid form, for example encapsulated in wax, or as gels.

EXAMPLES

Screening Method for Evaluating the Wetting Properties of Surfactant Solutions on Plastics The wetting properties of surfactant solutions on plastics were determined in a simplified screening test under the conditions/test parameters in a commercially available dishwasher, but without actually using one.

To evaluate the wetting properties, plastic test specimens measuring 20×5 cm are cleaned first with 1% NaOH and then with isopropanol. The test specimens thus pretreated are then immersed in the solution to be tested and immediately withdrawn again. Evaluation is carried out visually by drawing up a ranking list or on a scoring scale of 1 to 5 where a score of 5 means that the liquid film breaks up spontaneously and the wetting effect is completely eliminated. A score of 5 is obtained where water is used. A score of 1 signifies complete wetting of the plastic surface and uniform drainage of the liquid film (test substance: Maranil A55® COGNIS).

Test Parameters:

| | |
|---|---|
| Water hardness: | 2° d |
| Salt content: | 700 ppm |
| Temperature: | 60° C. |
| Surfactant concentration: | 0.05% (active substance) |

Test Specimens:

PP (polypropylene), PE (polyethylene), PC (polycarbonate)

The rest results are set out in Table 1 where C1, C2, C3, C4, C5 and C6 represent Comparison Examples and I, II, II and IV represent the Examples according to the invention.

TABLE 1

| Wetting properties on plastics | | | | | | | | | | |
|---|---|---|---|---|---|---|---|---|---|---|
| Composition in % active substance | C1 | C2 | C3 | C4 | I | II | II | IV | C5 | C6 |
| 2-Hydroxydodecylether-PEG1000-2-hydroxydodecylether (a) | — | 0.1 | — | — | 0.08 | 0.06 | 0.08 | 0.05 | 0.02 | 0.04 |
| 2-Hydroxydodecylether-PEG1500-2-hydroxydodecylether (a) | — | — | 0.1 | — | — | — | 0.02 | | | |
| $C_{12-14}$ FA + 5EO/4PO (Dehypon LS 54) (b) | — | — | — | 0.1 | 0.02 | 0.04 | | 0.05 | 0.08 | 0.06 |
| Ratio a:b | | | | | 4:1 | 3:2 | 4:1 | 1:1 | 1:4 | 2:3 |
| Consistency of a and b or mixtures thereof at RT | | Solid | Solid | Liquid | Solid | Solid | Solid | Solid | Liquid | Liquid |
| Water, 2° d/700 ppm NaCl | 100 | 99.9 | 99.9 | 99.9 | 99.9 | 99.9 | 99.9 | 99.9 | 99.9 | 99.9 |
| Welling properties on plastics | | | | | | | | | | |
| Temperature 60° C./plastic "PP" | 5 | 3 | 4 | 3 | 2 | 1 | 1 | 2 | 3 | 2 |
| Temperature 60° C./plastic "PE" | 5 | 3 | 3 | 3 | 2 | 1 | 2 | 3 | 3 | 2 |
| Temperature 60° C./plastic "PC" | 5 | 3 | 4 | 4 | 2 | 1 | 2 | 3 | 3 | 3 |

Clear Rinse Performance

Clear rinse performance was visually evaluated by examiners. Glasses, cutlery, plastic and china plates were washed under defined conditions in a domestic dishwasher. The washed tableware was then evaluated under defined light conditions (evaluation of stains and bloom). The results were expressed as "distinctly better/better/same as/worse than standard". The standard is redefined for each test series. The test results are set out in Table 2. C1, C2 and C3 represent Comparison Examples (=standard) while I to IV represent the Examples according to the invention.

TABLE 2

| Clear rinse performance | | | | | | | |
|---|---|---|---|---|---|---|---|
| Composition in % active substance | C1 | C2 | C3 | I | II | III | IV |
| 2-Hydroxydodecylether-PEG1000-2-hydroxydodecylether (a) | 15.0 | — | — | 12.0 | 9.0 | — | — |
| 2-Hydroxydodecylether-PEG1500-2-hydroxydodecylether (a) | — | — | 15.0 | — | — | 12.0 | 9.0 |
| C12/14-FA + 5EP + 4PO (b) | — | 15.0 | — | 3.0 | 6.0 | 3.0 | 6.0 |
| Ratio a:b | — | — | — | 4:1 | 3:2 | 4:1 | 3:2 |
| Na cumemesulfonate | 3.5 | 6.0 | 4.0 | 4.0 | 4.5 | 3.0 | 3.5 |
| Citric acid | 5.0 | 5.0 | 5.0 | 5.0 | 5.0 | 5.0 | 5.0 |
| Deionized water | | | | | | | |
| Cutlery | ○ | ○ | ○ | + | + | + | ○ |
| China | ○ | ○ | ○ | + | ○ | + | + |
| Plastic | ○ | ○ | + | ++ | + | ++ | + |

| Rise melting points/ranges | ° C. |
|---|---|
| 2-Hydroxydodecylether-PEG1000-2-hydroxydodceylether | 36 |
| 2-Hydroxydodecylether-PEG1000-2-hydroxydodecyl-ether/Dehypon LS 54 (4:1) | 34 |
| 2-Hydroxydodecylether-PEG1000-2-hydroxydodecyl-ether/Dehypon LS 54 (3:2) | 31 |
| C12/14-FA + 5EO + 4EO | Liquid at RT |

RT = room temperature
Clear rinse performance
+ = better than standard
○ = same as standard
— = worse than standard

What is claimed is:

1. A rinse agent composition containing:

(a) a gemini surfactant corresponding to formula I:

$$R—CHOH—CH_2—[OCH_2CH_2]_x—O—CH_2—CHOH—R \quad (I)$$

wherein R is a linear or branched alkyl and/or alkenyl radical having from about 4 to 22 carbon atoms, and x is a number from about 5 to 90;

(b) a fatty alcohol alkoxylate corresponding to formula II:

$$R^1O[CH_2(CH_3)CHO]_q(CH_2CH_2O)_rH \quad (II)$$

wherein $R^1$ is a linear or branched alkyl and/or alkenyl group having from about 4 to 22 carbon atoms, and q is a number from 0 to about 10, and r is a number from about 1 to 50; and (c) water, and wherein (a) and (b) are present in the composition in a ratio by weight of from about 1:1 to 4:1.

2. The composition of claim 1 wherein in formula I x is a number from about 10 to 45.

3. The composition or claim 1 wherein in formula I x is a number from about 12 to 35.

4. The composition of claim 1 wherein in formula I R is a linear alkyl radical having from about 8 to 12 carbon atoms.

5. The composition of claim 1 wherein about 80% by weight of the gemini surfactant present in the composition has all free hydroxyl groups of polyethylene glycol capped with 1,2-epoxyalkanes.

6. The composition of claim 1 wherein (a) and (b) are present in the composition in a ratio by weight of about 1.5:1.

7. The composition of claim 1 wherein (a) and (b) are present in the composition in a ratio by weight of about 3:1.

8. The composition of claim 1 wherein from about 85% to 100% by weight of the gemini surfactant present in the composition has all free hydroxyl groups of polyethylene glycol capped with 1,2-epoxyalkanes.

9. The composition of claim 1 wherein from about 95% to 100% by weight of the gemini surfactant present in the composition has all free hydroxyl groups of polyethylene glycol capped with 1,2-epoxyalkanes.

10. The composition of claim of claim 1 wherein the composition contains about 50% by weight, based on the weight of the composition, of water.

11. A process for cleaning a hard surface comprising contacting the surface with a composition comprising:

(a) a gemini surfactant corresponding to formula I:

$$R—CHOH—CH_2—[OCH_2CH_2]_x—O—CH_2—CHOH—R \quad (I)$$

wherein R is a linear or branched alkyl and/or alkenyl radical having from about 4 to 22 carbon atoms, and x is a number from about 5 to 90; and (b) a fatty alcohol alkoxylate corresponding to formula II:

$$R^1O[CH_2(CH_3)CHO]_q(CH_2CH_2O)_rH \quad (II)$$

wherein $R^1$ is a linear or branched alkyl and/or alkenyl group having from about 4 to 22 carbon atoms, and q is a number from 0 to about 10, and r is a number from about 1 to 50, and wherein (a) and (b) are present in the composition in a ratio by weight of from about 1:1to 4:1.

12. The process of claim 11 wherein in formula I x is a number from about 10 to 45.

13. The process of claim 11 wherein in formula I x is a number from about 12to 35.

14. The process of claim 11 wherein in formula I R Is a linear alkyl radical having from about 8 to 12 carbon atoms.

15. The process of claim 11 wherein about 80% by weight of the gemini surfactant present in the composition has all free hydroxyl groups of polyethylene glycol capped with 1,2-epoxyalkanes.

16. The process of claim 11 wherein (a) and (b) are present in the composition in a ratio by weight of about 1.5:1.

17. The process of claim 11 wherein (a) and (b) are present in the composition in a ratio by weight of about 3:1.

18. The process of claim 11 wherein from about 85% to 100% by weight of the gemini surfactant present in the composition has all free hydroxyl groups of polyethylene glycol capped with 1,2-epoxyalkanes.

19. The process of claim 11 wherein from about 95% to 100% by weight of the gemini surfactant present in the composition has all free hydroxyl groups of polyethylene glycol capped with 1,2-epoxyalkanes.

20. The process of claim of claim 11 wherein the composition contains about 50% by weight, based on the weight of the composition, of water.

* * * * *